US011111746B2

(12) United States Patent
Gumos

(10) Patent No.: US 11,111,746 B2
(45) Date of Patent: Sep. 7, 2021

(54) WELLBORE ARRANGEMENT

(71) Applicant: PETROLEUM TECHNOLOGY COMPANY AS, Stavanger (NO)

(72) Inventor: Michal Gumos, Stavanger (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 11 days.

(21) Appl. No.: 16/498,789

(22) PCT Filed: Mar. 28, 2018

(86) PCT No.: PCT/NO2018/050087

§ 371 (c)(1),
(2) Date: Sep. 27, 2019

(87) PCT Pub. No.: WO2018/182428

PCT Pub. Date: Oct. 4, 2018

(65) Prior Publication Data

US 2020/0080393 A1 Mar. 12, 2020

(30) Foreign Application Priority Data

Mar. 29, 2017 (NO) ..... 20170516

(51) Int. Cl.

| | |
|---|---|
| ***E21B 23/03*** | (2006.01) |
| ***E21B 23/01*** | (2006.01) |
| ***E21B 34/06*** | (2006.01) |
| ***E21B 43/12*** | (2006.01) |

(52) U.S. Cl.

CPC ..... *E21B 23/03* (2013.01); *E21B 23/01* (2013.01); *E21B 34/06* (2013.01); *E21B 43/123* (2013.01)

(58) Field of Classification Search

CPC ..... E21B 23/03; E21B 23/01; E21B 34/06; E21B 43/123

See application file for complete search history.

(56) References Cited

U.S. PATENT DOCUMENTS

| | | | | |
|---|---|---|---|---|
| 2,250,463 A | | 7/1941 | Boynton | |
| 3,741,299 A | | 6/1973 | Terral | |
| 4,673,036 A | | 6/1987 | Merritt | |
| 5,224,545 A | | 7/1993 | George et al. | |
| 5,355,952 A | * | 10/1994 | Meynier | E21B 23/03 166/250.01 |
| 2013/0025845 A1 | * | 1/2013 | Kleppa | E21B 23/03 166/65.1 |

FOREIGN PATENT DOCUMENTS

WO 1986/03544 A1 6/1986

OTHER PUBLICATIONS

PCT International Search Report; PCT/NO2018/050087; dated Jul. 9, 2018.

Norwegian Search Report; NO 20170516; dated Aug. 15, 2017.

* cited by examiner

*Primary Examiner* — Brad Harcourt

(74) *Attorney, Agent, or Firm* — Bracewell LLP; Constance G. Rhebergen; Linda L. Morgan

(57) ABSTRACT

A well component having a main bore and a lateral opening from the main bore, the well component further comprising a deflector surface arranged adjacent the lateral opening on an inner wall of the main bore and defining a path configured to guide one or more guide taps/fingers of a downhole tool away from the opening.

4 Claims, 4 Drawing Sheets

WELLBORE ARRANGEMENT

BACKGROUND

Field of the Disclosure

The present disclosure relates to wellbore arrangement, suitable for use with, for example, petroleum wells.

Description of the Related Art

In petroleum wells, various equipment and tools are used in the wellbore for assisting production or for other operations. Such operations may span a wide variety of activities, and it is common to use specialized equipment to carry out such activities downhole. This equipment may have functionality for being lowered into the well, positioned in location, and carry out a given operation.

One example of such downhole equipment and related operations is fluid injection systems. Some examples have been described in U.S. Pat. No. 3,561,528, WO 2008/118022, WO 98/26154, U.S. Pat. Nos. 3,752,231 and 9,394,754. Generally, when producing hydrocarbons, including water, oil and oil with entrained gas, from a geological formation, natural pressure in the reservoir acts to lift the produced fluids upwards to a surface through a production tubing. The reservoir pressure must exceed the hydrostatic pressure of the fluid in the well bore and back-pressure imposed by the production facilities at the surface of the well to produce naturally. This is not always the case and sometimes there is a need to assist the production flow through the production tubing. In addition, chemical injection is sometimes employed to assist the production and to preserve equipment.

For example, if the natural pressure in the reservoir has dropped such that the natural flow of liquid from the well has ceased or become too slow for economical production, artificial production methods can be employed. Several artificial production systems and/or methods are known, such as the use of submersible pumps or injection of a fluid medium into the production tubing or into the reservoir to stimulate flow. The fluid medium can be gas, liquid, processed well fluid or even a part of the well fluid from the reservoir. One of the most commonly used systems today is gas lift. In addition, chemicals are often injected into the production tubing to preserve equipment or for flow assurance.

The gas is typically injected through one or more gas lift valves arranged along the length of the production tubing, where the number of gas lift valves will depend on the needs in the field or well. In the case of chemical injection, valves may also be arranged at the desired depth or positioned appropriately along the length of the production tubing. The gas lift and chemical injection valves are usually arranged in side pocket mandrels forming a part of the production tubing, where a kick over tool is used to place and replace the valves in the side pocket mandrel. For example, if a gas lift valve arranged in a side pocket mandrel should be replaced with a new gas lift valve, the kick over tool is run down the production tubing to retrieve the old gas lift valve, and install the new gas lift valve. This can be done in separate operations (or "trips" down into the well), or removal and installation can be done in a single trip if the kick over tool has the capability for this.

Various other downhole tools, installations, or equipment, which may have other functions than gas or chemical injection, may be arranged and/or used in a similar manner.

A challenge with such downhole operations is that tools or equipment need to be controlled from surface. It is very important that a tool is activated in the correct position in the well, however this can be challenging, for example when running the tool on a wireline into the well, since the wireline may have some elasticity, the wellbore may be curved, etc., so that running the tool to the exact activation position may not be straight-forward. Moreover, it may be necessary that the tool be rotated in the wellbore, in order to orient it correctly in relation to downhole installations. For these purposes, the tool may be provided with one or more guiding taps or "fingers", which will cooperate with a guiding track (orientation sleeve) in a downhole unit. Typically, the tool is then lowered down to a position below its operating position, and then lifted into position. During lifting, the guiding tap(s)/finger(s) engages the guiding track (orientation sleeve), whereby the tool is rotated to its correct orientation and led to its correct operating position, in which it can be activated.

Such mechanical orientation, positioning and activation mechanisms for downhole tools or equipment may, however, be prone to failure, for example if it activates the tool (such as a kick over tool) in an incorrect position, or fails to position the tool in the right place for activation and use. This leads to lost time if the tool has to be retrieved and the operation repeated, and may also have economic and/or health and safety consequences if, for example, downhole operations are incorrectly executed. Consequently, there is a need for more efficient, secure and reliable systems and methods for performing operations downhole, including but not limited to the use, installation and/or retrieval of equipment or tools downhole.

The present disclosure has the objective to provide such a system and/or method with advantages over known solutions and techniques.

SUMMARY

In an embodiment, there is provided a well component having a main bore and a lateral opening from the main bore, the well component further comprising a deflector surface arranged adjacent the lateral opening on an inner wall of the main bore and defining a path configured to guide one or more guide taps/fingers of a downhole tool away from the opening.

In an embodiment, the deflector surface is spaced from the opening in a longitudinal direction of the main bore.

In an embodiment, the deflector surface extends between a first part which is spaced from the opening in a longitudinal direction of the main bore and a second part which is longitudinally at the same height as the opening and circumferentially spaced from the opening.

In an embodiment, the deflector surface spans a larger circumferential sector of the main bore than the opening does.

The well component may be a side pocket mandrel, the side pocket mandrel having a laterally offset side pocket bore, and where the opening extends between the main bore and the laterally offset side pocket bore. Alternatively, the well component may be a blow out preventer, a valve, a pipe, a chemical injection sub, a gas injection sub, or another type of component located in, or connected to, the well.

BRIEF DESCRIPTION OF THE DRAWINGS

Illustrative embodiments of the present disclosure will now be described with reference to the appended drawings, in which.

DETAILED DESCRIPTION

Embodiments will now be described in relation to a side pocket mandrel which is part of a production system for a petroleum well, however it is to be understood that the embodiments of this disclosure may be realized in a wide variety of other applications and equipment. This includes, but is not limited to, downhole pipes with one or more openings, BOPs, valves, chemical injection subs, or any other type of downhole equipment or installation.

In an embodiment, there is provided a side pocket mandrel which is part of a production tubing for a petroleum well. A kick over tool may be utilized to install and retrieve well bore devices (down hole devices), and particularly valves, such as gas lift valves, relief valves, water flood valves and steam injection valves which are positioned in the side pocket mandrel. The kick over tool may also be utilized to install and retrieve other well bore devices, such as different types of plugs, temperature or pressure sensors, flow measurements devices, etc. In addition, the kick over tool may also comprise equipment and/or tools for servicing and maintenance inside the side pocket mandrel and/or offset side pocket bore.

Figure 1:
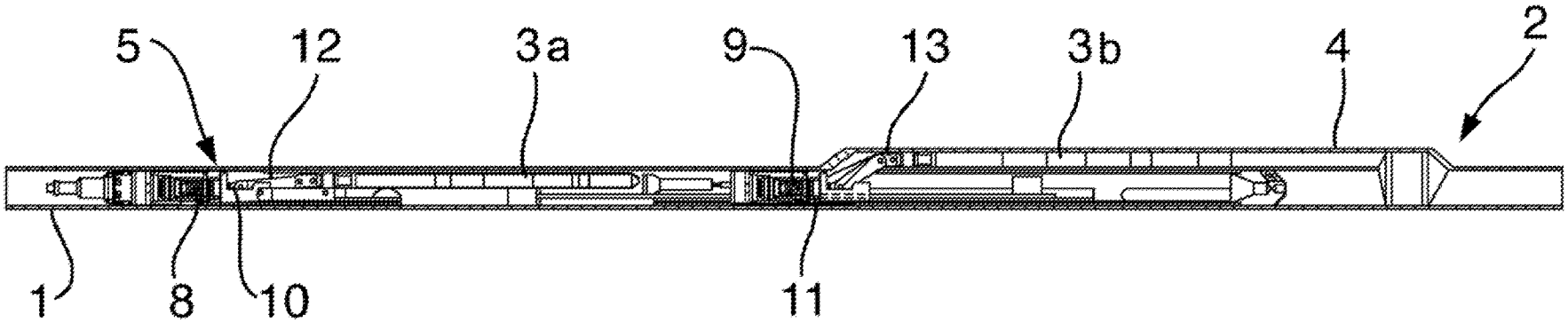
FIG. 1 shows a sectional and schematic view of part of a production tubing.

FIG. 1 shows part of a production tubing 1 comprising a side pocket mandrel 2 having a main bore which is generally aligned with the production tubing 1 and a laterally offset side pocket bore 4. A well bore device, in this embodiment a gas lift valve 3*b*, is arranged in the laterally offset side pocket bore 4 of the side pocket mandrel 2. A kick over tool 5 is connected to a conveyance member (e.g. a wire line or tractor, not shown), which controls the position of the kick over tool 5 from a surface location.

The kick over tool 5 has first and second setting devices 8, 9, where the first and second setting devices 8, 9 through respective stems/rods 10, 11 are connected to a first and second pivotally and articulated linkage mechanisms 12, 13 (first setting device 8 being connected to first pivotally and articulated linkage mechanism 12, and second setting device 9 being connected to second pivotally and articulated linkage mechanism 13) Each of the first and second pivotally and articulated linkage mechanisms 12, 13 can be extended outwardly from the kick over tool 5 when they are to perform an operation. In the embodiment shown, the second linkage mechanism 13 engages the gas lift valve 3*b* to remove it from the side pocket mandrel 2, while the first linkage mechanism 12 holds a replacement gas lift valve 3*a* to be arranged in the side pocket mandrel 2 after removal of the gas lift valve 3*b*.

Figure 2:
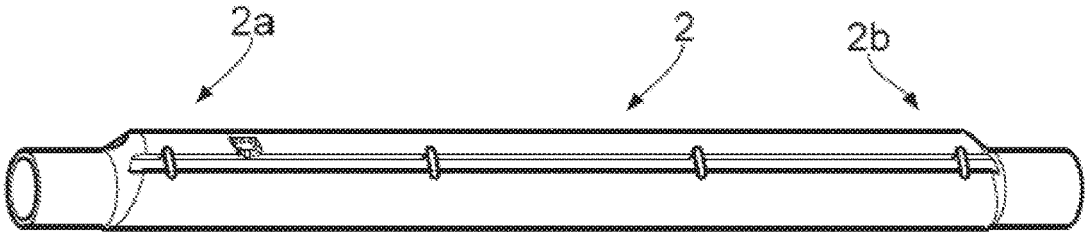
FIG. 2 shows a side pocket mandrel.
Figure 3:
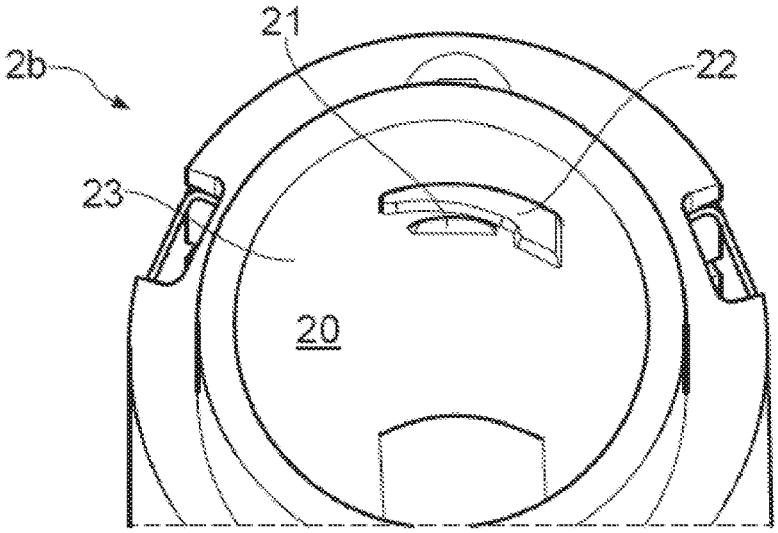
FIGS. 3 and 4 show parts of a side pocket mandrel.
Figure 4:
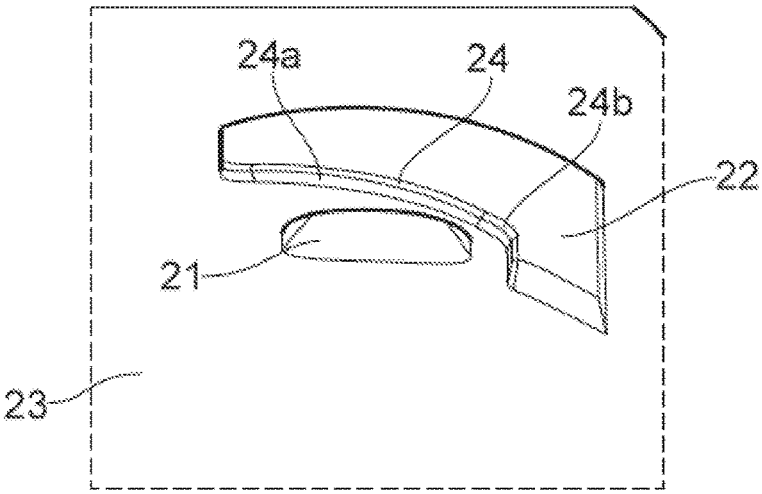

FIGS. 2-4 show the side pocket mandrel 2 in further detail. For clarity, the side pocket mandrel 2 is illustrated not connected to the production tubing 1. The side pocket mandrel 2 has a first, "uphole" part 2*a* and a second, "downhole" part 2*b*. As used herein, uphole and downhole shall refer to the respective parts' 2*a*, 2*b* location in relation to each other when the side pocket mandrel 2 is installed in the well, where the second part 2*b* will be located farther into the well than the first part 2*a*.

FIGS. 3 and 4 show a part of the side pocket mandrel 2, namely part of the main bore 20 as seen from the end of the side pocket mandrel 2 at the second part 2*b*. The main bore 20 has a lateral opening 21 (see also FIGS. 5-7) from the side pocket bore 4 into the main bore 20 through which a fluid can be injected into the main bore 20. The inventor has discovered that a problem associated with installing a kick over tool 5 in a side pocket mandrel 2 is that the opening 21 may disturb the positioning operation of the kick over tool 5. To alleviate this problem, the side pocket mandrel 2 comprises a recess 22 arranged in the inner wall 23 defining the inside bore 20. The recess 22 defines a deflector surface 24, which is configured to engage one or more guide taps/fingers 30 (see FIGS. 5-7) on the kick over tool 5 and guide the guide tap(s)/finger(s) 30 away from the opening 21. The deflector surface 24 is arranged with an angle such as to guide the guide tap(s)/finger(s) 30 circumferentially along the inner circumference of the main bore 20 and away from the opening 21. The deflector surface 24 thereby turns the kick over tool 5 such that the guide tap(s)/finger(s) 30 pass the opening 21 on the side of the opening 21, and does not risk getting caught by the edge of the opening 21.

Figure 5:
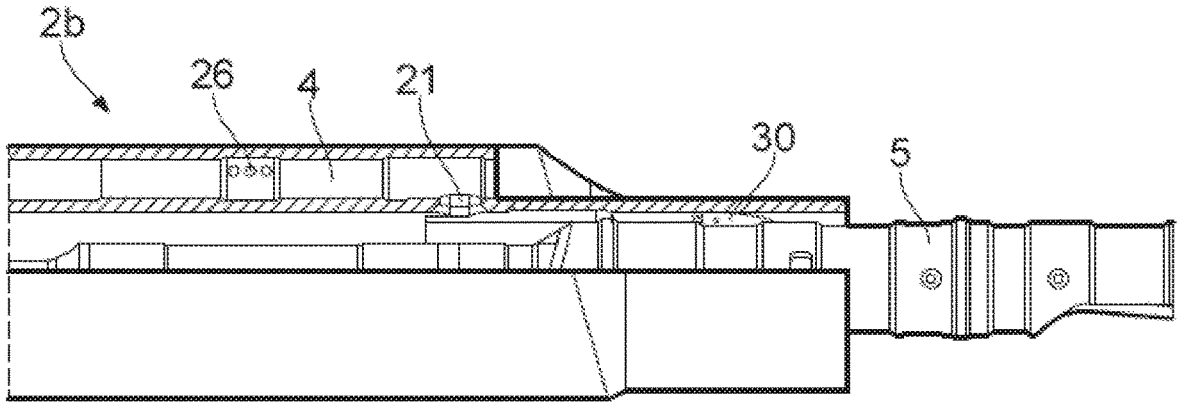
FIGS. 5-7 show steps of positioning a kick over tool in a side pocket mandrel.
Figure 6:
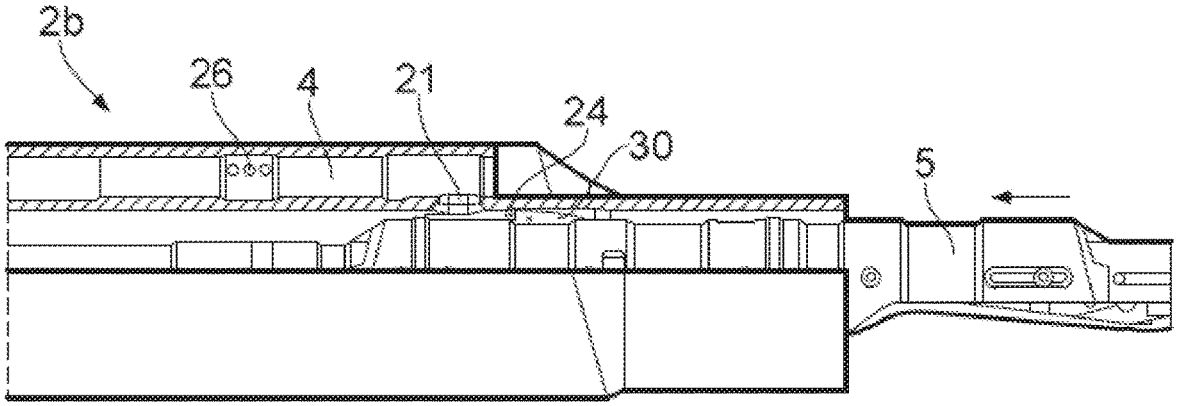
Figure 7:
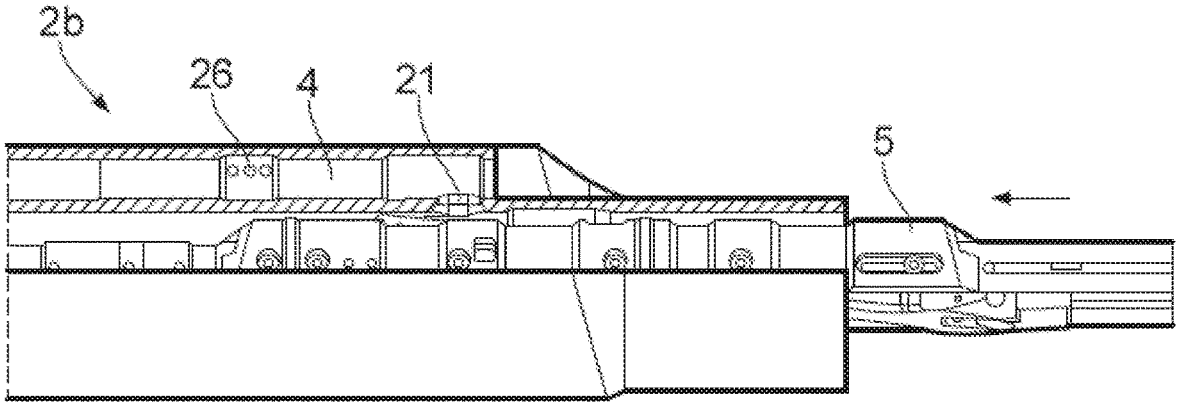

FIGS. 5-7 illustrate the use of the side pocket mandrel 2. For clarity, the production tubing 1 is not shown in FIGS. 5-7, and the side pocket mandrel 2 is shown in a partially cut view. It may, for example, during a petroleum operation be desirable to install a new gas lift valve (not shown) in the laterally offset side pocket bore 4. The gas lift valve may then control the flow of a fluid from inlet ports 26, leading from an outside of the side pocket mandrel 2 into the laterally offset side pocket bore 4, to the opening 21. In this manner, gas lift can be employed by providing pressurized gas in an annulus between the production tubing 1 and the well casing, and leading it into the production tubing 1.

To install (or remove) the gas lift valve, or to install or remove other devices, a kick over tool 5 having a guide tap/finger 30 is lowered into the well, for example via a wireline, to a position slightly lower than its operating position. This is shown in FIG. 5, with the right hand side being a direction into the well (the downhole side). The kick over tool 5 is then hoisted, as indicated by the arrow in FIG. 6, to bring it into engagement with the side pocket mandrel 2 and lock it in its operating position. In this process, there might be a risk that the guide tap/finger 30 engages the opening 21 and activates the kick over tool 5 in the incorrect position, and/or break shear pins intended for use only to release the kick over tool 5 when the installation/removal operation has finished. As the kick over tool 5 moves upwards, the guide tap/finger 30 engages the deflector surface 24 (see FIG. 6), whereby the entire kick over tool 5 will be turned slightly, as shown in FIG. 7, and whereby the kick over tool 5 can proceed to its operating position within the side pocket mandrel 2 without disturbance from the opening 21.

The deflector surface 24 may be arranged on one side of the opening 21, as illustrated in FIGS. 3 and 4, or on both sides (both uphole and downhole) if required. The deflector surface 24 can be spaced from the opening 21 with a suitable distance in the longitudinally in relation to the main bore 20. The distance can be chosen to be close enough to the opening 21 such as to minimize the risk that the kick over tool 5 turns back in the reverse direction after having been turned by the deflector surface 24. Alternatively, the deflector surface 24 may extend between a part 24*a* longitudinally spaced from the opening 21 to a part 24*b* longitudinally at the same height as the opening 21 but circumferentially spaced from the opening 21. (See FIG. 4.) Guiding the guide tap/finger 30 entirely past the opening 21 in this manner ensures that the kick over tool 5 cannot turn back for the guide tap/finger 30 to engage the opening 21.

Figure 8:
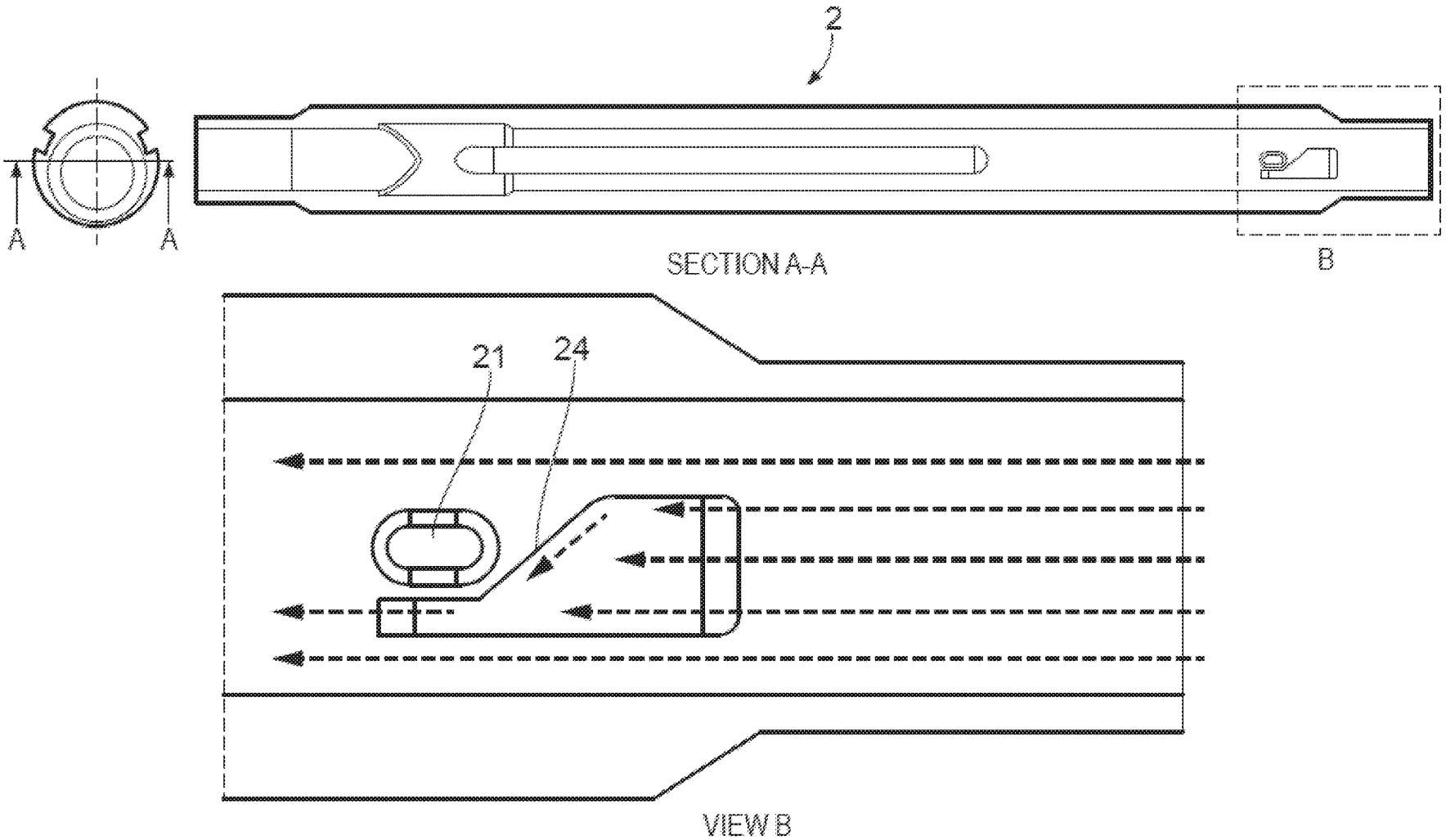
FIG. 8 shows aspects of a side pocket mandrel.

FIG. 8 illustrates an embodiment of a side pocket mandrel 2, similar to that described above and with the same reference numerals indicating the same components. In FIG. 8, the dashed arrows indicate the possible path of the guide tap/finger 30. If the kick over tool 5 has an orientation such that the guide tap/finger 30 will not pass over the opening 21, no turning is necessary. If the guide tap/finger 30 may enter a circumferential sector of the main bore 20 on which the opening 21 lies, as indicated by the central three dashed arrows, the deflector surface 24 will lead the guide tap/finger 30 to the side of the opening 21 and past the opening 21 without risk that the opening 21 interferes with the operation of the kick over tool 5.

It may be advantageous if the deflector surface 24 spans a larger circumferential sector of the main bore 20 than the opening 21 does, as shown in FIG. 8.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the embodiments of this disclosure in diverse forms thereof.

The present disclosure is not limited to the embodiments described herein; reference should be had to the appended claims.

That claimed is:

1. A well component having a main bore and a lateral opening from the main bore, the well component further comprising a deflector surface arranged adjacent the lateral opening on an inner wall of the main bore and longitudinally extending from a location spaced from the opening in a longitudinal direction of the main bore, to a location longitudinally at the same height as and circumferentially spaced from the lateral opening in the main bore, such that the deflector surface defines a path configured to guide one or more radially protruding guide taps/fingers of a downhole tool in a circumferential direction and away from the opening by engagement of the guide taps/fingers with the path so as to turn the downhole tool in the main bore.

2. A well component according to claim 1, wherein the deflector surface spans a larger circumferential sector of the main bore than the opening does.

3. A well component according to claim 1, wherein the well component is a side pocket mandrel, the side pocket mandrel having a laterally offset side pocket bore, and where the opening extends between the main bore and the laterally offset side pocket bore.

4. A well component according to claim 1, wherein the well component is selected from a group consisting of a blow out preventer, a valve, a pipe, a chemical injection sub, and a gas injection sub.

* * * * *